US011421433B2

(12) United States Patent
Fried

(10) Patent No.: US 11,421,433 B2
(45) Date of Patent: Aug. 23, 2022

(54) ANCHOR PLATE SYSTEM FOR REINFORCING MASONRY WALLS

(71) Applicant: Craft Pro Masonry Restorations, Inc., Hulmeville, PA (US)

(72) Inventor: Michael Fried, Hulmeville, PA (US)

(73) Assignee: Craft Pro Masonry Restorations, Inc., Hulmeville, PA (US)

( * ) Notice: Subject to any disclaimer, the term of this patent is extended or adjusted under 35 U.S.C. 154(b) by 73 days.

(21) Appl. No.: 16/920,624

(22) Filed: Jul. 3, 2020

(65) Prior Publication Data

US 2022/0003010 A1 Jan. 6, 2022

(51) Int. Cl.

| | |
|---|---|
| ***E04B 1/38*** | (2006.01) |
| ***E04G 23/02*** | (2006.01) |
| ***E04F 13/08*** | (2006.01) |
| ***E04B 1/41*** | (2006.01) |

(52) U.S. Cl.
CPC ..... *E04G 23/0296* (2013.01); *E04B 1/40* (2013.01); *E04F 13/0833* (2013.01)

(58) Field of Classification Search
None
See application file for complete search history.

(56) References Cited

U.S. PATENT DOCUMENTS 752,930 A * 2/1904 Silver ..... E04H 17/08 52/151
893,676 A * 7/1908 Tschantz ..... A47G 1/102 403/402
1,053,231 A * 2/1913 Schweikert ..... 52/426
1,176,903 A * 3/1916 Johnston ..... E04G 9/02 249/189
1,684,187 A * 9/1928 Loening ..... B64C 35/00 114/271
1,982,088 A * 11/1934 White ..... E04B 2/58 52/282.4
3,353,312 A 11/1967 Storch
4,021,990 A * 5/1977 Schwalberg ..... E04B 1/4178 52/479
4,596,102 A * 6/1986 Catani ..... E04F 13/0821 52/508
4,773,794 A 9/1988 Harke
4,790,114 A 12/1988 Falco
4,930,284 A 6/1990 Falco
(Continued)

*Primary Examiner* — Basil S Katcheves
(74) *Attorney, Agent, or Firm* — LaMorte & Associates P.C.

(57) ABSTRACT

A system and method of retroactively reinforcing an exterior wall. A first anchor plate is provided having a central connection point and peripheral connection points. The center connection point is connected to an anchor tether. An opening is drilled through the exterior wall and at least some joists. The anchor tether is advanced through the drilled opening. Within the drilled opening, the anchor tether anchors to at least some of the joists. The first anchor plate is attached to the anchor tether and the anchor tether is tensioned. Secondary anchor plates can be also be attached to the exterior wall at different points. Lateral tethers are provided that interconnect the first anchor plate to the secondary anchor plates. The lateral tethers extend along the surface of the exterior wall at a perpendicular to the anchor tethers.

18 Claims, 8 Drawing Sheets

(56) References Cited

U.S. PATENT DOCUMENTS

| | | | | |
|---|---|---|---|---|
| 5,640,825 | A * | 6/1997 | Ehsani | E04G 23/0218 428/408 |
| 5,644,889 | A | 7/1997 | Getz | |
| 5,852,907 | A * | 12/1998 | Tobin | E04B 2/8652 52/714 |
| 6,094,880 | A * | 8/2000 | Thompson | E04B 1/2608 52/712 |
| 7,404,274 | B2 | 7/2008 | Hayes | |
| 7,823,354 | B2 * | 11/2010 | Wheatley | E04G 23/0218 52/506.01 |
| 8,555,587 | B2 | 10/2013 | Hohmann, Jr. | |
| 9,334,646 | B2 * | 5/2016 | Hohmann, Jr. | E04B 1/4178 |
| 2006/0254193 | A1 * | 11/2006 | Platts | E04B 7/04 52/713 |
| 2009/0158678 | A1 | 6/2009 | Ginter et al. | |
| 2010/0037552 | A1 * | 2/2010 | Bronner | E04B 1/4178 52/713 |
| 2012/0315081 | A1 * | 12/2012 | Bouldin | E04B 1/003 403/205 |
| 2014/0215956 | A1 * | 8/2014 | Smith | E04B 1/003 52/705 |
| 2015/0299999 | A1 * | 10/2015 | Koblasz | E04B 1/003 52/703 |
| 2017/0298611 | A1 * | 10/2017 | Callahan | E04B 1/003 |
| 2018/0216337 | A1 * | 8/2018 | Scotta | E04B 1/40 |

* cited by examiner

ANCHOR PLATE SYSTEM FOR REINFORCING MASONRY WALLS

BACKGROUND OF THE INVENTION

1. Field of the Invention

In general, the present invention relates to anchor plates and the methodology used when installing anchor plates. More particularly, the present invention relates to the structure of the anchor plate, the structure of the anchor tether that engages the anchor plate, and the methodology of installing anchor plates and anchor tethers in preexisting walls that are in need of reinforcement.

2. Prior Art Description

Many buildings contain masonry walls that are made of brick, block, or stone. The masonry may form the structure of a wall or may just be a façade in front of a traditional lumber wall. Regardless, due to a variety of reasons, such as ground settlement, load shifting, water damage or the like, masonry walls can develop warps and buckles over time. Once a warp or buckle begins, it tends to increase in severity over time until the wall loses its structural integrity.

Recognizing that warps occur in many masonry walls, anchor plates are often added to masonry walls. Variations of anchor plate reinforcement have been in use for hundreds of years. Anchor plates are metal plates that are bolted to the framework of a building through a hole in the masonry wall. The anchor plate is an enlarged plate that presses against the exterior of the masonry wall, therein preventing the masonry wall from buckling outwardly. Since the anchor plate is visible on the exterior of the wall, the anchor plate is traditionally given a decorative shape, such as a star. As such, anchor plates are also commonly referred to as star plates.

Anchor plates are held in place by an anchor tether. The anchor tether can be a bolt, cable, or rod that extends through a hole in the masonry wall and engages the central framework of the building. Within the building, anchor tethers are commonly anchored to multiple floor joists in order to spread the forces transferred through the anchor tether. This provides the anchor strength needed to resist the pulling force of a bowing wall without damaging the building framework. Alternatively, the anchor tether can be extended through multiple floor joists between opposing walls in order to reinforce both opposing walls. Accordingly, although anchor plates and anchor tethers are relatively easy to install during new construction when joists are exposed, they are notoriously difficult to install retroactively when joists are encased between floors and ceilings.

When a slight warp or buckle is noticed in a masonry wall, it is desirable to install an anchor plate in order to stop the warp or buckle from progressing further. However, to retroactively install an anchor plate, a hole must be drilled in the masonry at an elevation that horizontally aligns with floor joists. This typically limits the position of the anchor plates to approximately one foot for every ten feet of vertical wall. Walls often buckle in the area between joists. Accordingly, there is a good chance that the anchor plate cannot be installed in the section of the wall where it would do the most good. Furthermore, to retroactively install an anchor plate, the joists inside the building must be exposed to provide access. This requires that a large section of a floor or a large section of a ceiling be cut open to expose the joists. In this manner, room is provided to drill holes through the joists to accommodate the anchor tether being used so the anchor tether can be affixed to the joists.

A need therefore exists for an improved anchor plate system that can be retroactively added to masonry wall that enables masonry walls to be supported at positions that do not align with floor joists. A need also exists for an improved anchor plate system that can be retroactively attached to joists without having to remove large sections of flooring or ceiling to expose joists inside the building. These needs are met by the present invention as described and claimed below.

SUMMARY OF THE INVENTION

The present invention is a system and method of retroactively reinforcing an exterior wall of a building having at least one floor that is supported with floor joists. In accordance with the present invention, a first anchor plate is provided. The first anchor plate has a central connection point and peripheral connection points. The center connection point of the anchor plate is connected to an anchor tether. An opening is drilled through the exterior wall of the building and through at least some of said joists. The hole is drilled from a point outside the building. The hole is inspected with a scope as the drilling progresses in order to prevent drilling into obstructions. The anchor tether is advanced into building through the drilled opening. A small, easily repaired access hole is cut into floor or ceiling adjacent to the joists. The access hole is used to terminate the anchor tether and attached the anchor tether to the joints. One end of the anchor tether remains outside the exterior wall. The first anchor plate is attached to the anchor tether and the anchor tether is tensioned. This biases the anchor plate against the exterior wall.

Secondary anchor plates can be also be attached to the exterior wall at different points. Lateral tethers are provided that interconnect the first anchor plate to the secondary anchor plates. The lateral tethers attach to the peripheral connection points on the anchor plates. The lateral tethers extend along the surface of the exterior wall at a perpendicular to the anchor tethers. The result is a web of anchor plates and tethers that can reinforce a compromised wall.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention reinforcement system can be embodied in many ways, only a few exemplary embodiments are illustrated. The exemplary embodiments are being shown for the purposes of explanation and description. The exemplary embodiments are selected in order to set forth some of the best modes contemplated for the invention. The illustrated embodiments, however, are merely exemplary and should not be considered limitations when interpreting the scope of the appended claims.

Figure 1:
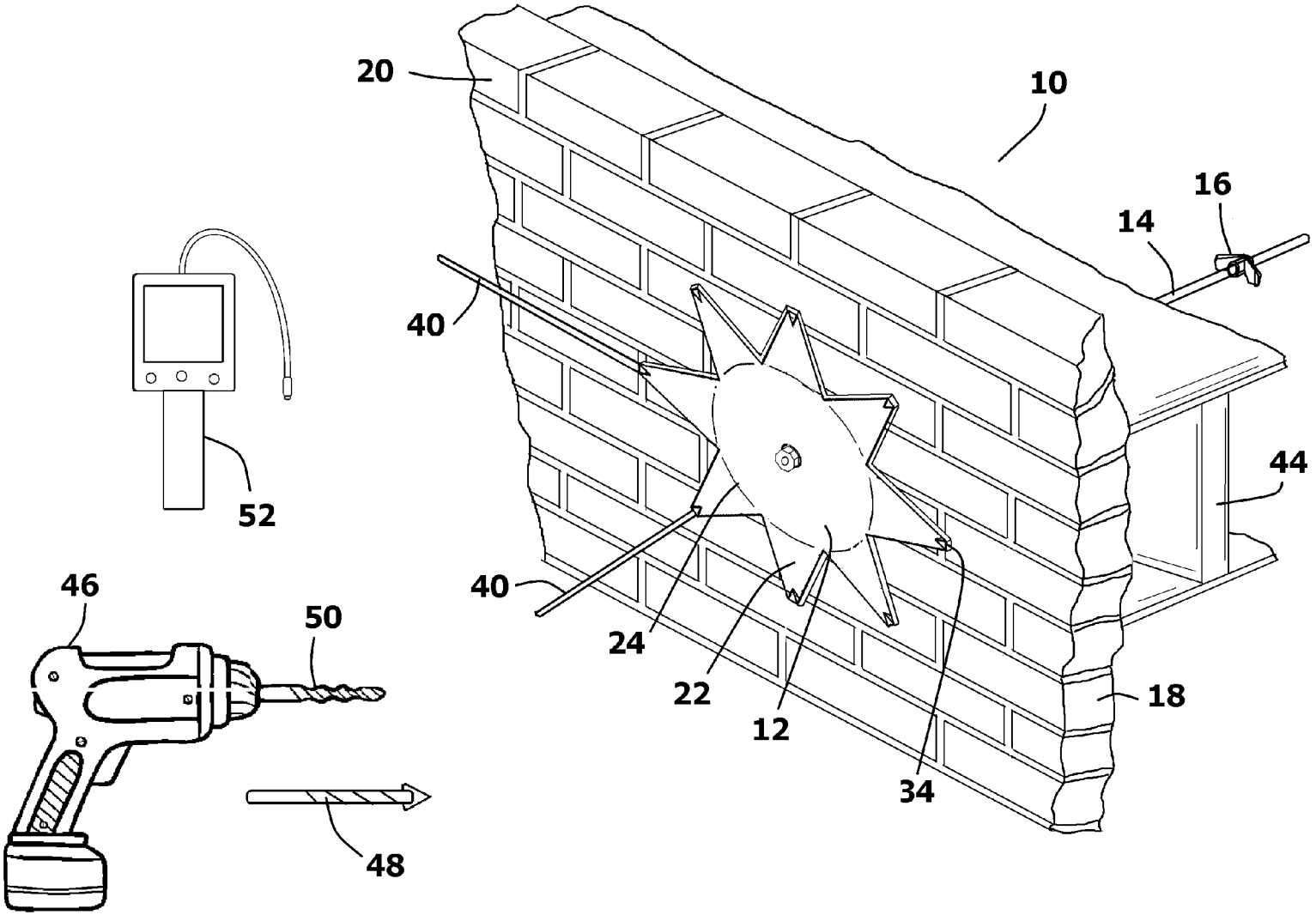
FIG. 1 is a fragmented view of a wall in a building in which an exemplary embodiment of the reinforcement system is installed with joists parallel to the wall.
Figure 2:
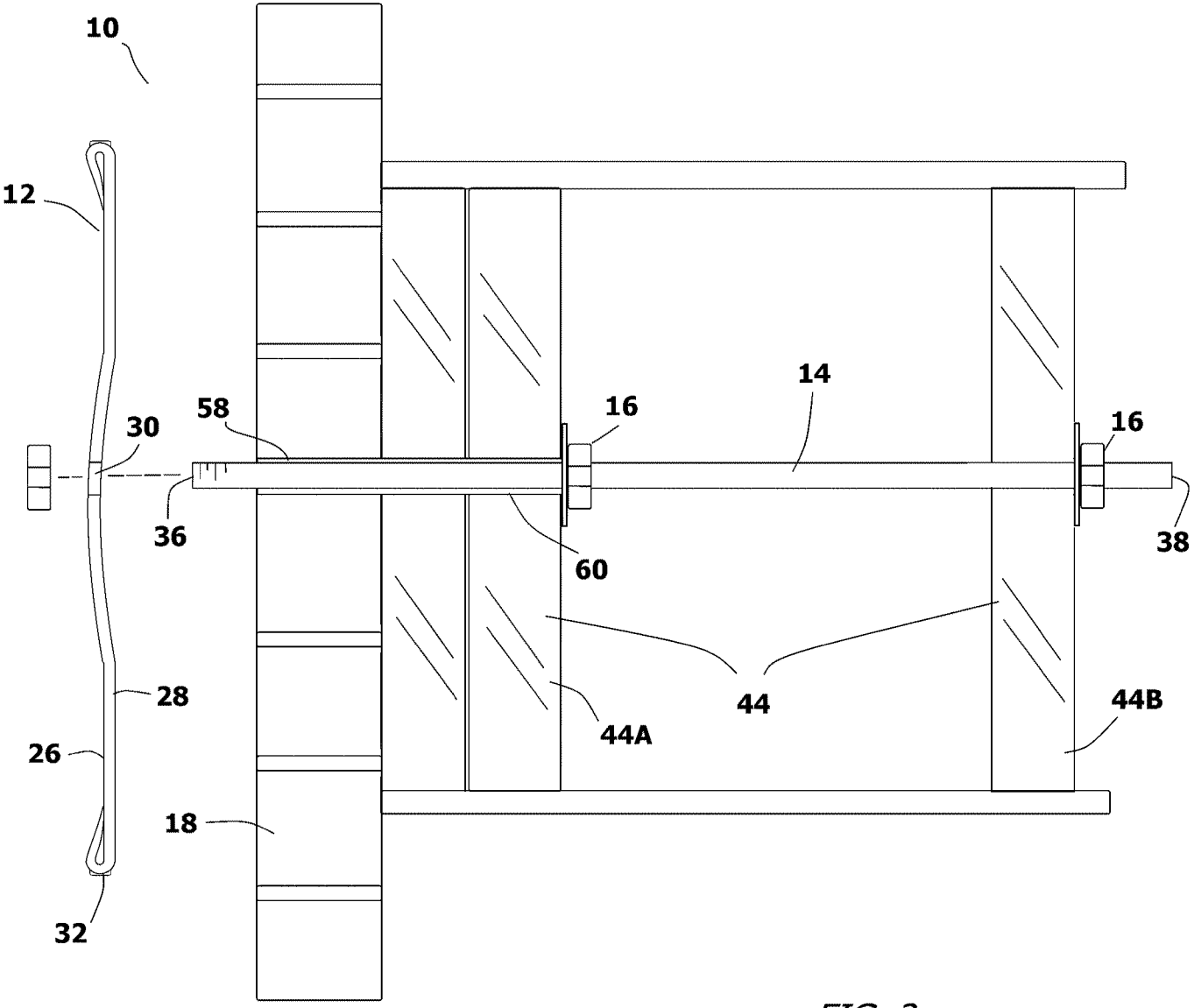
FIG. 2 is a cross-sectional view of the exemplary embodiment of FIG. 1.

Referring to FIG. 1 and FIG. 2, an improved reinforcement system 10 is shown. The reinforcement system 10 includes an anchor plate 12, an anchor tether 14, and anchor mounts 16. As will be explained, the anchor tether 14 and anchor mounts 16 are retroactively added to a building 20. The anchor plate 12 is attached to the anchor tether 14 and is biased against a masonry wall 18 by the anchor tether 14. This reinforces the masonry wall 18.

The anchor plate 12 has a plurality of arms 22 that radially extend from a central area 24. In the shown embodiment, the anchor plate 12 is star-shaped having eight arms 22. However, it should be understood that other shapes such as cross shapes and variant polygonal stars can also be used. The anchor plate 12 has a face surface 26 and an opposite contact surface 28. In use, the contact surface 28 will abut against the masonry wall 18. The anchor plate 12 can be made of a variety of material, but is preferably made of stainless steel, galvanized steel, or some other high strength metal alloy that is resistant to rust and is capable of being exposed to the elements for decades. The anchor plate 12 can be flat but is preferably slightly curved. The contact surface 28 of the anchor plate 12 is preferably slightly concave. In this manner, when biased against a masonry wall 18, the anchor plate 12 will deform and flatten to create a spring bias against the masonry wall 18. This spring bias will help keep the anchor plate 12 in contact with the wall 18 as the building 20 expands and shrinks with changes in temperature, pressure, and humidity.

A mounting hole 30 is formed in the geometric center of the anchor plate 12. This is a central connection point. The mounting hole 30 is used to interconnect the anchor tether 14 to the anchor plate 12. Furthermore, there are mechanical connectors 32 formed into the salient end of each of the arms 22. These are peripheral connection points. In the shown embodiment, the mechanical connectors 32 are threaded holes 34 formed into the ends of the arms 22. However, it should be understood that other types of mechanical connectors can be formed into, or attached to, the ends of the arms 22.

The anchor tether 14 can be a steel bolt, rod, chain, or cable. The anchor tether 14 has a first end 36, a second end 38 and a length between the ends 36, 38. The first end 36 of the anchor tether 14 is configured to attach to the anchor plate 12 through the mounting hole 30 in the central area 24 of the anchor plate 12. In the shown embodiment, the first end 36 of the anchor tether 14 is threaded and is attached over the anchor plate 12 using a threaded nut 37. Alternatively, it will be understood that the anchor tether 14 can be terminated with a bolt head, therein eliminating the need for the threaded nut 37.

The second end 38 of the anchor tether 14 is inserted into the building 20. The length of the anchor tether 14 depends upon anchor features available within the building 20, such as joists 44, and the forces expected to act upon the anchor plate 12. If the joists 44 in the building 20 are parallel to the wall 18, as is shown in FIG. 2, the anchor tether 14 is preferably extends through multiple joists 44 and is locked with an anchor mount 16 at each of the joists 44 to help spread any tensile forces experienced by the anchor tether 14. The anchor mounts 16 are installed in a manner later described.

Figure 3:
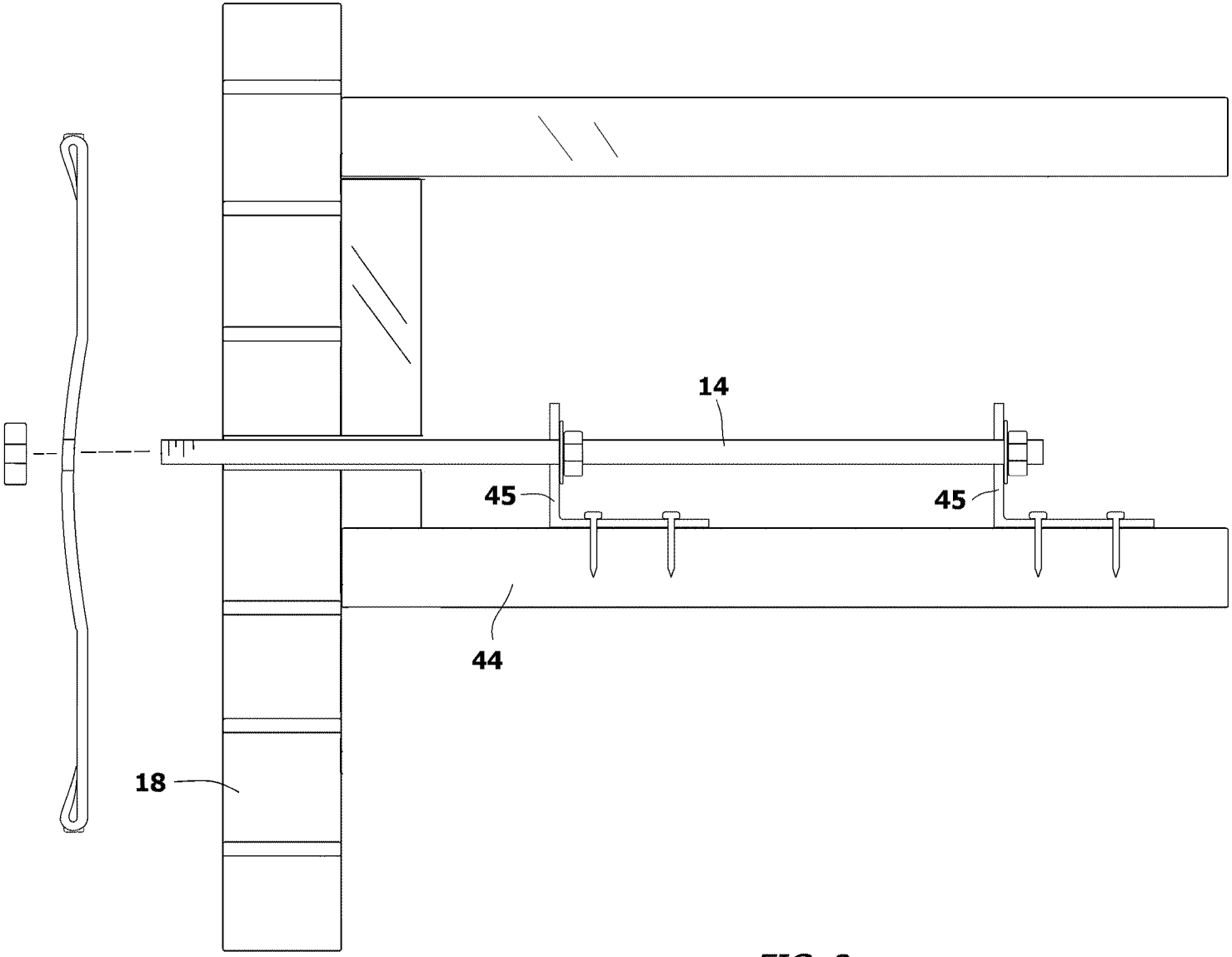
FIG. 3 is a fragmented view of a wall in a building in which an exemplary embodiment of the reinforcement system is installed with joists perpendicular to the wall.

In certain situations, the joists 44 may be perpendicular to the wall, rather than parallel. Referring to FIG. 3, it will be understood that in this situation, brackets 45 are nailed or screwed to the joists 44. The anchor tether 14 is then extended through the brackets 45 as anchor tether 14 is advanced into the building.

Figure 4:
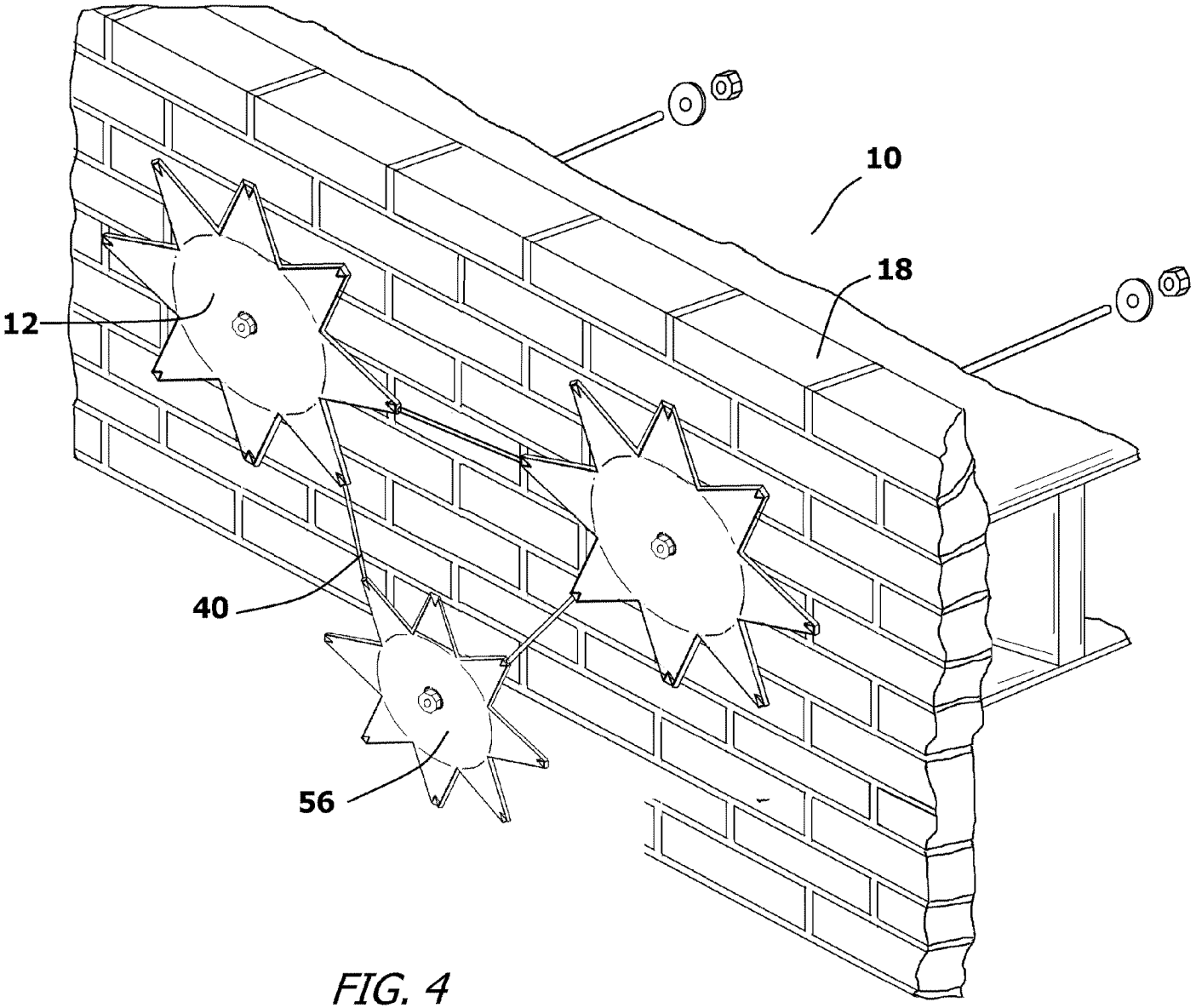
FIG. 4 is a fragmented view of a wall in a building in which the exemplary embodiment of the reinforcement system is installed using multiple anchor plates.
Figure 5:
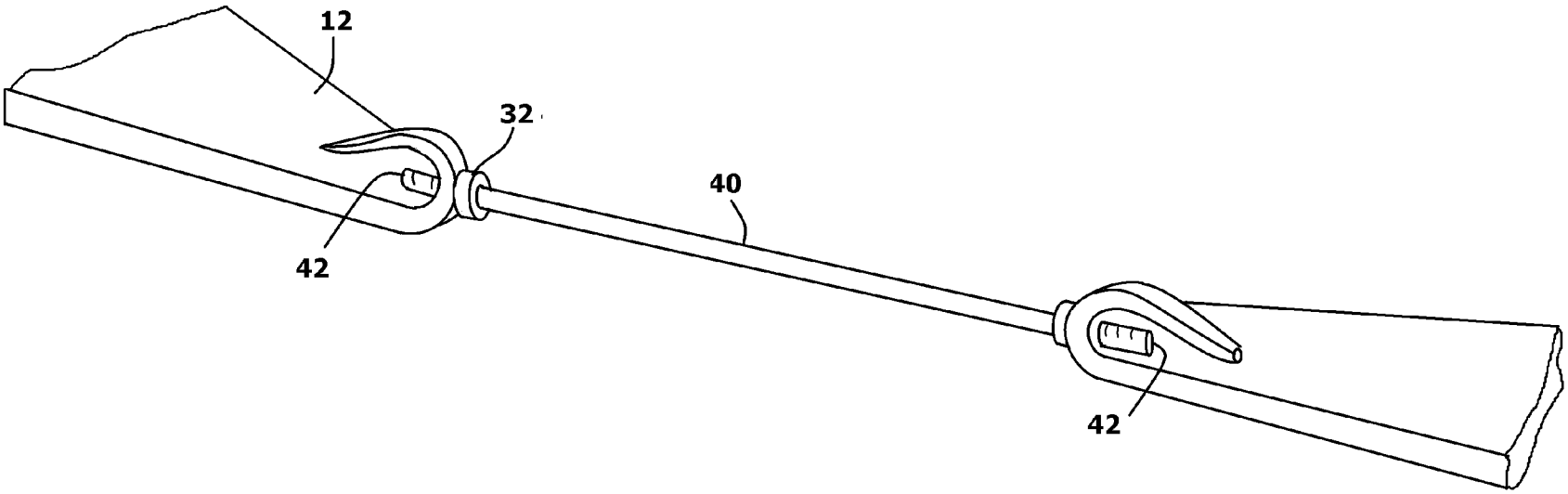
FIG. 5 is a fragmented view showing the interconnection of anchor plates with a lateral tether.

Referring to FIG. 4 and FIG. 5, in conjunction with FIG. 2, it can be seen that lateral tethers 40 are also provided as part of the reinforcement system 10. The lateral tethers 40 can be rigid rods but are preferably lengths of flexible cable. If the masonry wall 18 is a brick wall with mortar lines between rows of bricks, it is preferred that the lateral tethers 40 be sized to fit into the mortar lines, so as not to be visually prominent on the masonry wall 18. Each lateral tether 40 has two opposing ends 42. The ends 42 are terminated in a manner that enables the ends 42 of the lateral tether 40 to selectively interconnect with the mechanical connectors 32 at the ends of the anchor plates 12. In this manner, the lateral tethers 40 interconnect different anchor plates 12 on the exterior of the masonry wall 18. The lateral tethers 40, therefore, are oriented at a perpendicular to the anchor tethers 14. Any number of anchor plates 12 can be interconnected by lateral tethers 40, therein forming a net of lateral tethers 40 on a building 20. The lateral tethers 40 can bend around corners and pass over moldings, windows, and other features on, or in, the masonry wall 18.

It is preferred that the lateral tethers 40 interconnect with the anchor plates 12 with threaded connections. In this manner, individual lateral tethers 40 can be tightened or loosened during installation without the need of a secondary tensioning device.

Figure 6:
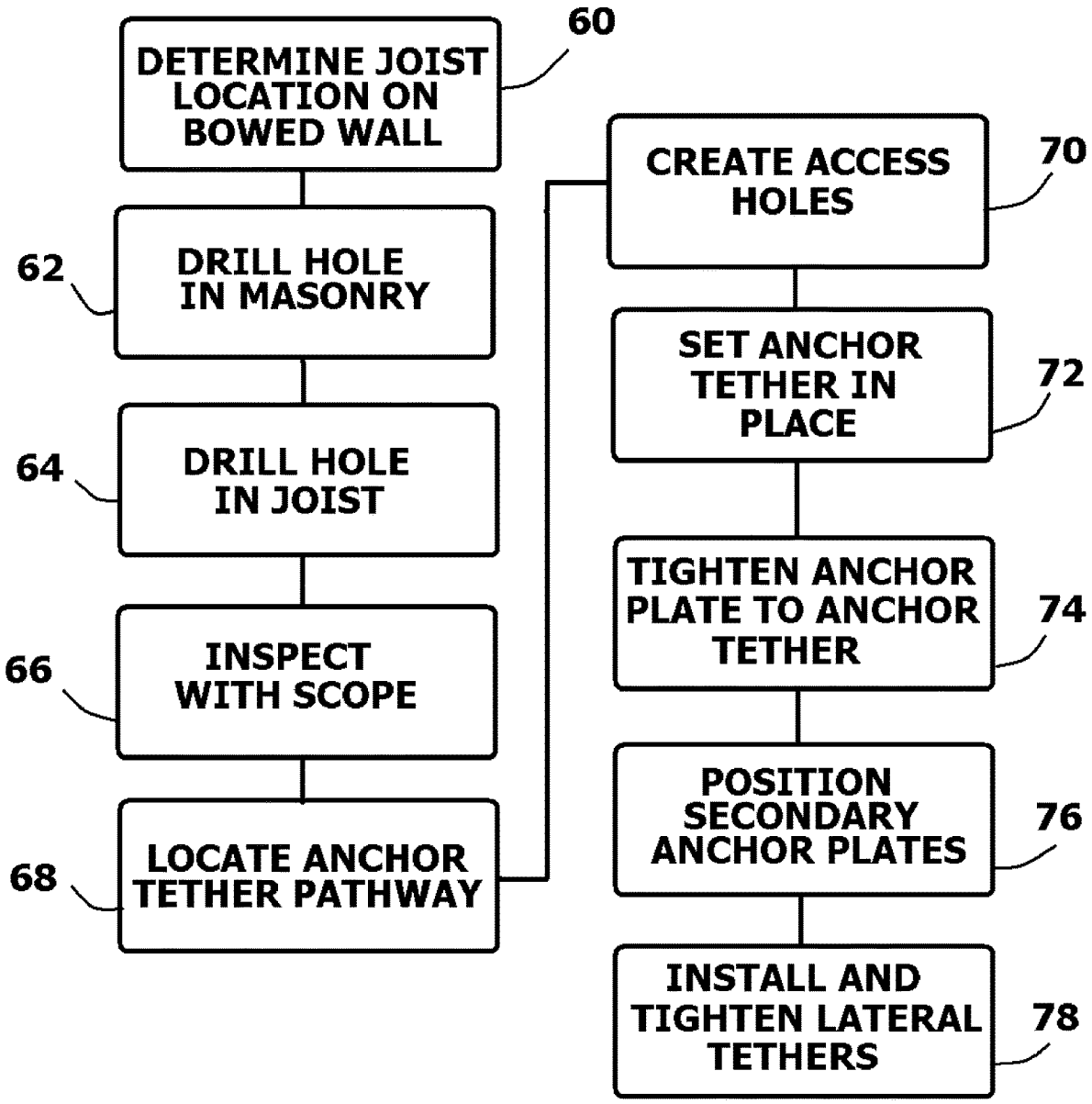
FIG. 6 is a block diagram outlining a methodology for installing the reinforcement system.

Referring to FIG. 6 in conjunction with FIG. 1, FIG. 2, FIG. 3 and FIG. 4, the method of implementing the present invention reinforcement system 10 is described. The method requires the use of tools show in FIG. 1. The tools include a drill 46, a masonry drill bit 48, a wood drill bit 50 and an optical scope 52. As is indicated by Block 60, the positions on a masonry wall 18 that correspond to floor joists and/or roof joists are determined by observation and measurement. Primary anchor plates 12 are then set. The primary anchor plates 12 are the anchor plates 12 that are directly mounted to floor/roof joists 44.

To set a primary anchor plate 12, a first hole 58 is drilled through the masonry wall 18 using a masonry drill bit 48. See Block 64. Once the first hole 58 is drilled through the masonry wall 18, the masonry drill bit 48 is replaced with the wood drill bit 50. A second hole 60 is drilled through a first joist 44A. The optical scope 52 is then advanced through the first joist 44A to inspect that the straight path to the next joist 44B is free of wiring, plumbing or other obstacles. If so, the wooden drill bit 50 is used to drill through the next joist 44B. This process is repeated until a pathway is formed through multiple joists 44. See Block 64 and Block 66. The anchor tether 14 is advanced into the pathway.

Inside the building, small inspection holes are made in the floor or ceiling. The optical scope 52 is inserted into the inspection holes to locate the position of the anchor tether 14 and the joists 44. See Block 68. Once located, access holes are cut into the floor or ceiling. See Block 70. The access holes are just large enough to advance the anchor mounts 16 into position to engage the anchor tether 14. The anchor mounts 16 are threaded nuts, toggles or similar mechanical connectors that selectively attached to the anchor tether 14 at the appropriate points. This configures the anchor tether 14 and sets the anchor tether 14 in place. See Block 72. This engages the anchor tether 14 with the joists 44 to spread any tension load into the joists 44. If the joists 44 are perpendicular to the wall, brackets 45 are joined to the joists 44 through the access holes. The anchor tether 14 is then joined to the brackets 45 as if the brackets 45 were joists.

The first end 36 of the anchor tether 14 is accessible on the exterior of the masonry wall 18. The anchor plate 12 is placed over the anchor tether 14 and the anchor tether 14 is tightened to the anchor plate 12. See Block 74. As the anchor tether 14 is tensioned, the anchor mounts 16 engage the joists 44 inside the building 20. The anchor tether 14 is tightened until it deforms at least some of the curvature out of the anchor plate 12. Any excess anchor tether 14 that extends beyond the anchor plate 12 can be trimmed.

Once the primary anchor plates 12 are installed, then the secondary anchor plates 56 can be installed. The secondary anchor plates 56 are anchor plates that do not align with joists 44 within the building 20. The secondary anchor plates 56 are placed over buckles or other deformations in the masonry wall 18. See Block 76. The secondary anchor plates 56 can be mounted into the masonry wall 18 using a cement bolt or similar fastening system. Alternatively, the secondary anchor plates 56 can be left free floating should the integrity of the masonry wall 18 be unable to support an invasive anchor.

Once both the primary anchor plates 12 and the secondary anchor plates 56 are in place, the lateral tethers 40 are installed. See Block 78. The lateral tethers 40 are attached to the arms 22 of the primary anchor plates 12 and the secondary anchor plates 56. The lateral tethers 40 are then tightened. The lateral tethers 40 can be strung across a problem area or configured into a larger net that can reinforce most all of a masonry wall 18. In this manner, walls can be prevented from buckling, and buckled walls can be prevented from falling.

Figure 7:
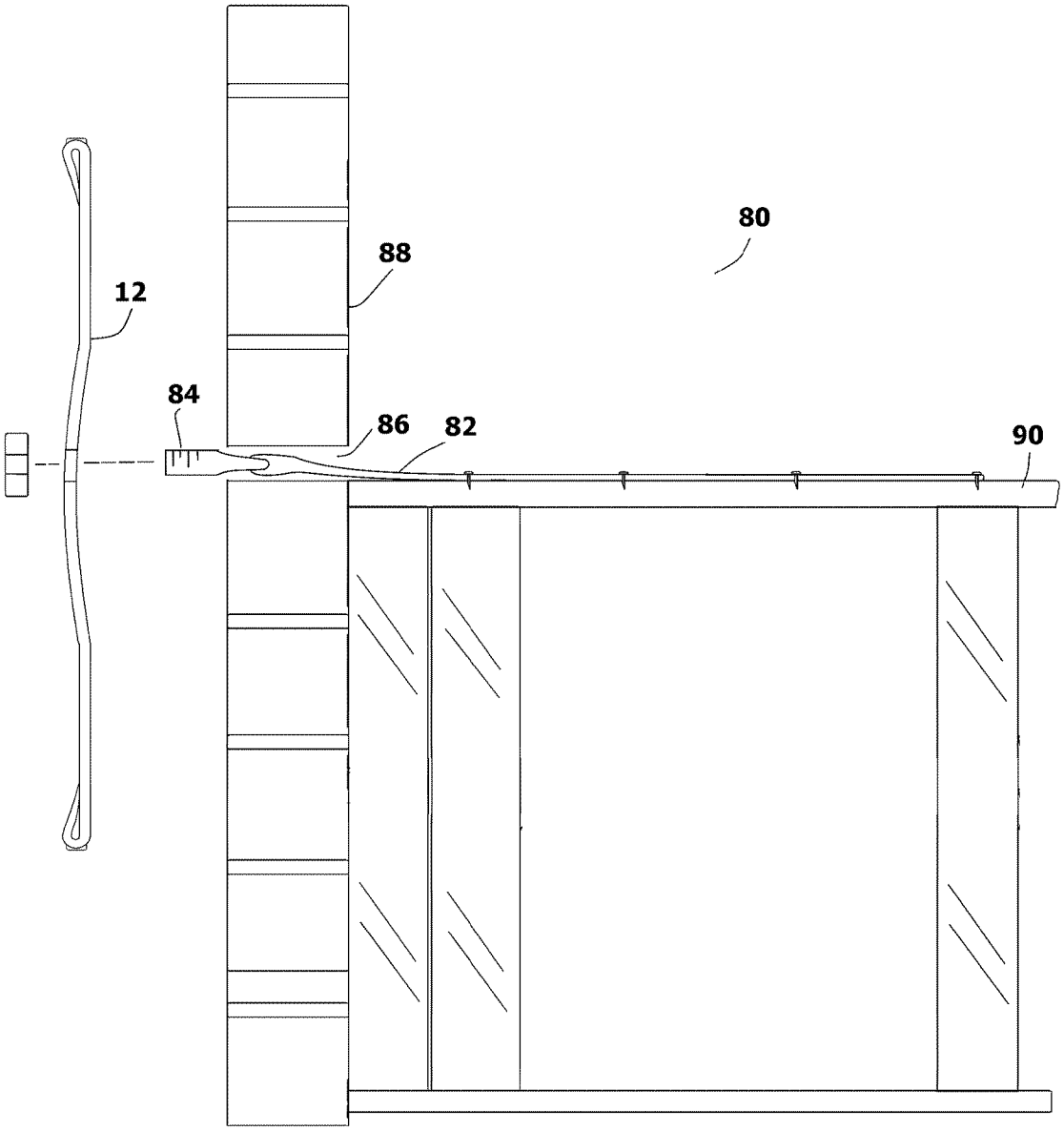
FIG. 7 is a fragmented view of a wall in a building in which an alternate exemplary embodiment of the reinforcement system is installed.

Referring to FIG. 7, an alternate embodiment of a reinforcement system 80 is shown. In this embodiment, the anchor plate 12 is the same as previously described. As such, the anchor plate 12 is identified with the same reference number. The anchor tether 82, however, and the method of installation have been changed. In the shown embodiment, the anchor tether 82 is a length of flexible strapping that is terminated at one end with a threaded connector 84. In a situation that requires a rapid repair to a wall buckle, a hole 86 can be drilled into a buckled wall 88 at the level of a floor 90 within the building. The anchor tether 82 can be advanced through the hole 86 and nailed or stapled to the floor 90 within the building. The threaded connector 84 at the end of the anchor tether 82 can then be attached to the anchor plate 12 and tightened. The buckling force of the wall 88 is then transferred to the floor 90 of the building. The floor 90 of the building is affixed to all the joists under the floor 90. Thus, the buckling wall 88 can be stabilized.

Figure 8:
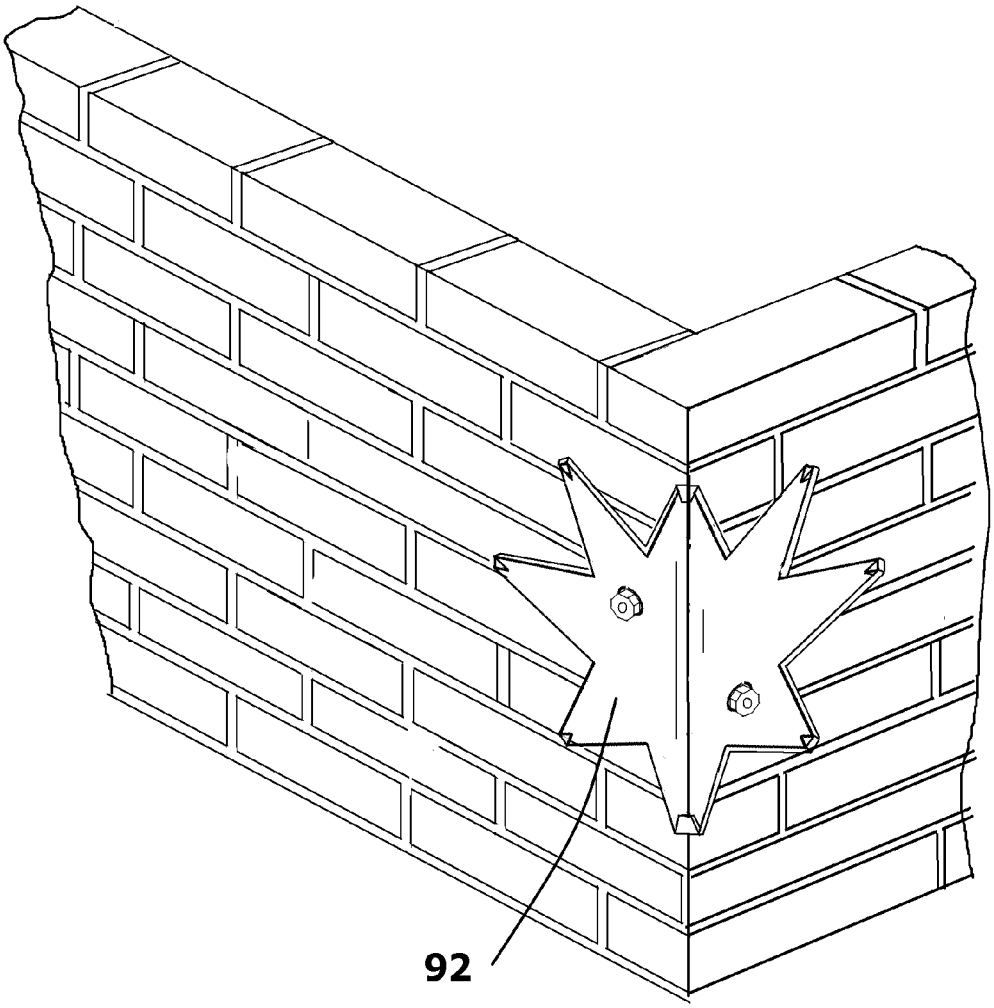
FIG. 8 shows a variation of an anchor plate for use on a corner.

In the earlier embodiments, the anchor plate is designed to press against a relatively flat wall. However, this need not be the case. Referring to FIG. 8, an embodiment of an anchor plate 92 is shown that is bent at a right angle. Such an anchor plate 92 can be used along corners of a building, should the corner be buckled or otherwise compromised. Such a corner anchor plate 92 can also be used with flat anchor plates when creating a reinforcement web that passes around a corner of a building.

It will be understood that the embodiments of the present invention that are illustrated and described are merely exemplary and that a person skilled in the art can make many variations to those embodiments. For instance, the size, thickness and length of the anchor plates and anchor tethers can be varied to meet the needs and aesthetics of a particular building. All such embodiments are intended to be included within the scope of the present invention as defined by the claims.

What is claimed is:

1. A method of retroactively reinforcing a masonry wall of a building, wherein said masonry wall has an exterior surface and said building has at least one floor supported with floor joists, said method comprising the steps of:

providing a first anchor plate, having a mounting hole formed therethrough;

providing an anchor tether having a first end and an opposite second end;

drilling an opening through said masonry wall;

advancing said second end of said anchor tether into said building through said opening, wherein said first end of said anchor tether remains outside said opening;

anchoring said anchor tether to at least one of said joists;

advancing said first end of said anchor tether into said mounting hole of said first anchor plate and attaching said first anchor plate to said anchor tether; and tensioning said anchor tether to bias said first anchor plate against said exterior surface of said masonry wall.

2. The method according to claim 1, wherein said mounting hole is centered in said first anchor plate.

3. The method according to claim 2, wherein said first anchor plate has a curvature and said tensioning said anchor tether to bias said first anchor plate against said exterior surface of said masonry wall acts to flatten said first anchor plate against said exterior surface.

4. The method according to claim 2, further including providing at least one subsequent anchor plate and interconnecting said first anchor plate to said at least one subsequent anchor plate with lateral tethers along said exterior surface of said masonry wall.

5. The method according to claim 4, wherein said first anchor plate has peripheral connection points configured to interconnect with said lateral tethers, wherein said peripheral connection points are symmetrically disposed around said mounting hole.

6. The method according to claim 1, wherein anchoring said anchor tether to at least one of said joists includes providing anchor mounts, positioning said anchor mounts on said anchor tether and attaching said anchor mounts to at least one of said joists.

7. The method according to claim 1, further including drilling subsequent holes in said joists through said opening drilled in said masonry wall.

8. The method according to claim 7, wherein advancing said second end of said anchor tether into said building through said opening includes cutting at least one access hole within said building for accessing said second end of said anchor tether within said building.

9. The method according to claim 7, further including advancing an optical scope through said first hole to inspect said joists prior to drilling said subsequent holes.

10. A method of retroactively reinforcing a masonry wall of a building, wherein said masonry wall has an exterior surface and said building has at least one floor supported by floor joists, said method comprising the steps of:

providing a plurality of anchor plates, wherein each of said plurality of anchor plates has a central connection point and peripheral connection points that are symmetrically disposed around said central connection point;

providing a plurality of lateral tethers that are separate and distinct from each other;

anchoring said plurality of anchor plates to said exterior surface of said masonry wall, wherein each of said plurality of anchor plates is anchored through said central connection point;

interconnecting at least some of said plurality of anchor plates by attaching said lateral tethers between at least some of said plurality of anchor plates, wherein said lateral tethers attach to said peripheral connection points, and wherein said lateral tethers extend along said exterior surface of said masonry wall.

11. The method according to claim 10, wherein anchoring said plurality of anchor plates to said exterior surface of said masonry wall includes drilling openings through said masonry wall and through at least some of said joists from points outside of said building.

12. The method according to claim 11, wherein anchoring said plurality of anchor plates to said exterior surface of said masonry wall includes advancing anchor tethers into said building through said openings and anchoring said anchor tethers to at least some of said joists.

13. The method according to claim 12, wherein anchoring said plurality of anchor plates to said exterior surface of said masonry wall includes tensioning said anchor tethers to bias said plurality of anchor plates against said exterior surface of said masonry wall.

14. The method according to claim 13, wherein said plurality of anchor plates each have a curvature and said tensioning said anchor tethers to bias said plurality of anchor plates against said exterior surface of said masonry wall acts to flatten said plurality of anchor plates against said exterior surface of said masonry wall.

15. The method according to claim 14, wherein anchoring said anchor tethers to at least some of said joists includes providing anchor mounts, positioning said anchor mounts on said anchor tether and attaching said anchor mounts to at least one of said joists.

16. The method according to claim 12, wherein drilling said openings through said exterior wall and through at least some of said joists from points outside of said building includes drilling initial holes through said exterior surface of said masonry wall and drilling subsequent holes in said joists through said initial holes.

17. A reinforcement anchor for retroactively reinforcing a masonry wall of a building, wherein said masonry wall has an exterior surface and said masonry wall is supported by joists, said reinforcement anchor comprising:

an anchor plate having a central connection point and a plurality of peripheral connection points that are symmetrically disposed around said central connection point;

an anchor tether having a first end and an opposite second end, wherein said first end is connected to said central connection point;

at least one anchor mount set on said anchor tether that enables said anchor tether to mechanically engage at least some of said joists; and lateral tethers connected to at least some of said peripheral connection points of said anchor plate, wherein said lateral tethers extend from said anchor plate at a perpendicular to said anchor tether so that the lateral tethers can lay flush along the exterior surface of the masonry wall.

18. The anchor according to claim 17, wherein said anchor tether and said lateral tethers connect to said anchor plate with threaded connections that enable said anchor tether and said lateral tethers to be selectively adjusted in tension.

* * * * *